US007299808B2

(12) United States Patent
Lau

(10) Patent No.: US 7,299,808 B2
(45) Date of Patent: Nov. 27, 2007

(54) CUSHION GRIP HAIR CLIP

(75) Inventor: Ping Chiu Lau, Kowloon Bay (HK)

(73) Assignee: Helen of Troy Limited, St. Michael (BB)

( * ) Notice: Subject to any disclaimer, the term of this patent is extended or adjusted under 35 U.S.C. 154(b) by 311 days.

(21) Appl. No.: 11/104,147

(22) Filed: Apr. 12, 2005

(65) Prior Publication Data

US 2006/0225763 A1 Oct. 12, 2006

(51) Int. Cl.
*A45D 8/20* (2006.01)

(52) U.S. Cl. ..... 132/277

(58) Field of Classification Search ..... 132/273, 132/275–279

See application file for complete search history.

(56) References Cited

U.S. PATENT DOCUMENTS 649,848 A * 5/1900 Koenig ..... 132/279
3,841,340 A 10/1974 Solomon
5,082,011 A 1/1992 Wu
5,590,668 A 1/1997 Macy
5,664,589 A 9/1997 Black
5,706,839 A 1/1998 Patti
5,787,905 A 8/1998 Yasuda
5,833,335 A 11/1998 Voughlohn
5,890,494 A 4/1999 Sonstegard
6,116,251 A 9/2000 Stachowski
6,142,159 A 11/2000 Lloyd
6,257,251 B1 7/2001 Burleson et al.
6,302,554 B1 10/2001 Holce
6,311,699 B1 * 11/2001 Horman ..... 132/278
6,386,207 B2 5/2002 Stewart
2002/0162564 A1 * 11/2002 Head et al. ..... 132/276
2003/0061688 A1 4/2003 Rodriguez et al.
2004/0065341 A1 4/2004 La Fauci
2004/0154633 A1 8/2004 Rogers et al.
2004/0182408 A1 9/2004 De LaForcade
2004/0182412 A1 9/2004 Vogel
2006/0162738 A1 * 7/2006 Chudzik et al. ..... 132/278

FOREIGN PATENT DOCUMENTS

GB 161262 A * 4/1921
JP 09206121 A * 8/1997

* cited by examiner

*Primary Examiner*—Todd E. Manahan
(74) *Attorney, Agent, or Firm*—O'Keefe, Egan, Peterman & Enders

(57) ABSTRACT

An improved hair clip and method of making a hair clip is provided. More particularly, the engaging members of a hair clip are provided with a cushioned surface that does not need to be attached to the external surface of the engaging member. Rather, the engaging members of the hair clip may be formed with holes and the outer cushion surface may be formed by material that protrudes through the holes in the engaging member. In one embodiment, the cushion material may be injection molded into the hair clip in a manner that results in the cushion material being forced through the holes in the engaging member in order to form a surface that may contact the hair.

18 Claims, 4 Drawing Sheets

CUSHION GRIP HAIR CLIP

TECHNICAL FIELD OF THE INVENTION

This invention relates to hair retention mechanisms and, more particularly, to hair clips having a cushioned gripping surface.

BACKGROUND

There are a wide variety of types of devices used to retain hair in a desired position. Commonly such devices may be called hair clips. For example, one type of hair clip is a barrette. Barrettes often utilize two clasping members which when clipped together may engage or pinch the hair in place. Another type of hair clip generally known in the art is a jaw hair clip. Jaw hair clips typically utilize two comb shaped retaining members which are disposed with a spring that presses the retaining members together. Hair may then be held in place by the force of the two retaining members. Barrettes and jaw hair clips are just two types of hair clips and many other hair clips and variations of such hair clips are known in the art.

The portions of a hair clip that engage the hair (for example the clasps of a barrette or the comb shaped retaining members of a jaw hair clip) are often made of materials comprised of hard plastic, metal, or the like. Portions of the surfaces of the hard plastic or metal engaging members may be coated for a number of reasons. For example, a layer of foam, rubber, or synthetic material may be coated on the engaging members so as to provide a surface that has an increased coefficient of friction as compared to hard plastic or metal. Such coatings may provide an improved gripping of the hair as the increased coefficient of friction results in less slippage of the hair. In addition, such coatings may be utilized so that the layer engaging the hair is compressible and thus resulting in less damage to the hair from the pinching action of the hair clip. Such coatings may be glued or attached to the outer surface of the surface of the engaging members. It would be desirable to achieve the advantages of such coatings without having to attach the coating to an external surface of the engaging members.

SUMMARY OF THE INVENTION

The present invention provides an improved hair clip and method of making a hair clip. More particularly, the engaging members of a hair clip are provided with a cushioned surface that does not need to be attached to the external surface of the engaging member. Rather, the engaging members of the hair clip may be formed with holes and the outer cushion surface may be formed by material that protrudes through the holes in the engaging member. In one embodiment, the cushion material may be injection molded into the hair clip in a manner that results in the cushion material being forced through the holes in the engaging member in order to form a surface that may contact the hair.

In one embodiment, a method for forming a hair clip is provided. The method may comprise providing a hair engagement member formed of a first material and providing at least one void space within the hair engagement member. The method further comprises filling at least a portion of the void space within the hair engagement member with a gripping material, wherein the gripping material has at least one property different from the first material and protruding at least a portion of the gripping material through at least one hole in the first material so that the gripping material extends outward from a surface of the first material so as to provide a contact surface for gripping hair when the hair clip is in use.

In another embodiment, a method for forming a hair clip is also provided. The method may comprise providing a hair engagement member comprised of a hard material to form at least one jaw of the jaw hair clip and providing at least one void space within the hair engagement member. The method further comprises injection molding a gripping material within at least a portion of the void space within the hair engagement member; wherein the gripping material has at least one property different from the first material. The injection molding process results in protruding at least a portion of the gripping material through at least one hole in a surface of the first hard material to form a gripping protrusion. Further, the gripping material may be softer than the hard material.

In another embodiment, a hair clip is provided. The hair clip may comprise a body formed of a first material and a space formed within the body. The hair clip may further include a hole that extends from an exterior surface of the main body to the space within the body and a gripping material that is formed within at least a portion of the space within the main body. The gripping material further extends through the hole outward of a surface of the first material. The gripping material has at least one property different from the first material and the extension of the gripping material through the hole forms a gripping protrusion that a has surface for gripping hair.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE INVENTION

Figure 1:
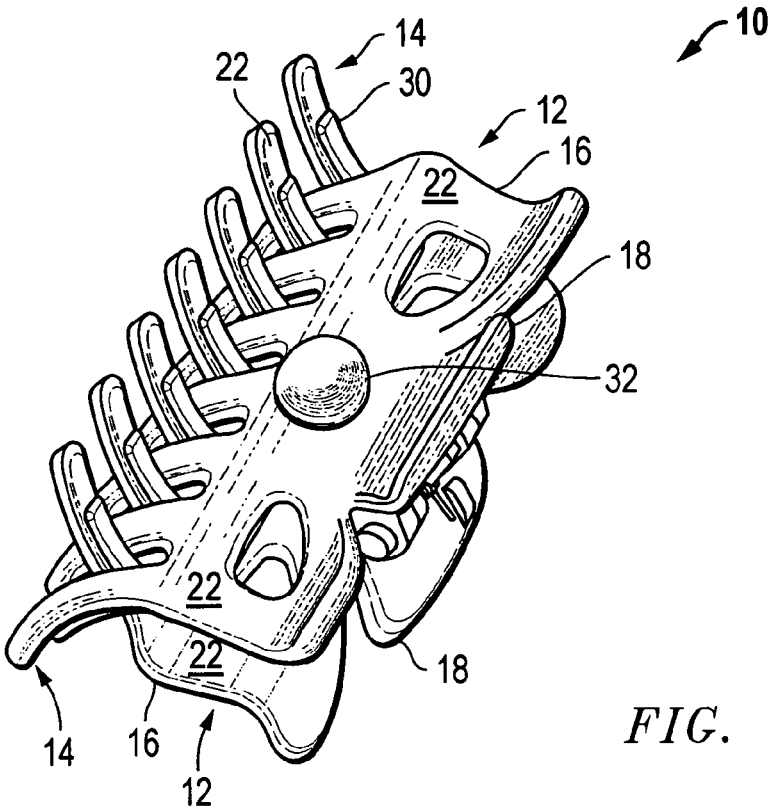
FIGS. 1-3 illustrate varying perspective views of an exemplary hair clip of the present invention
Figure 2:
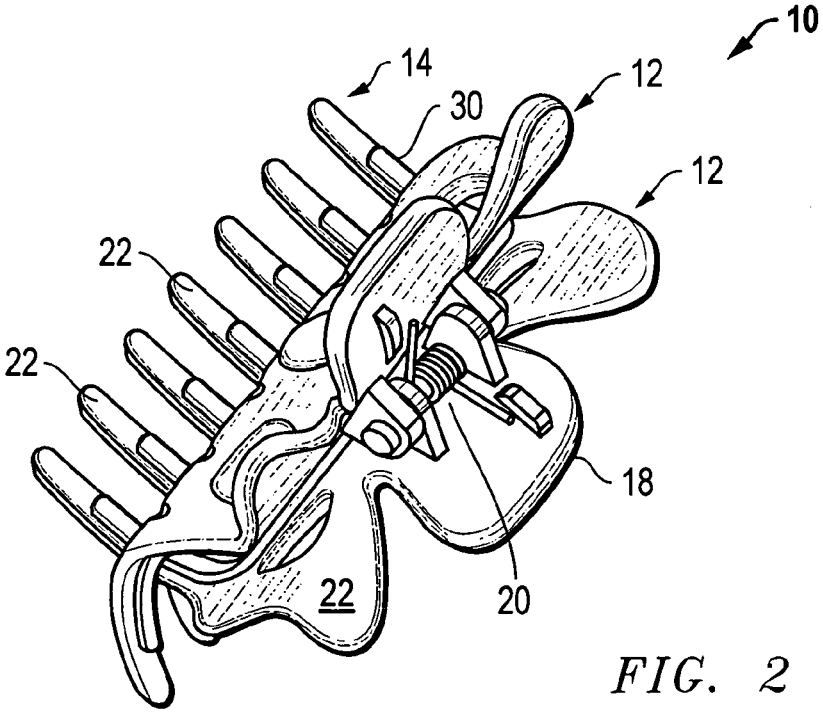
Figure 3:
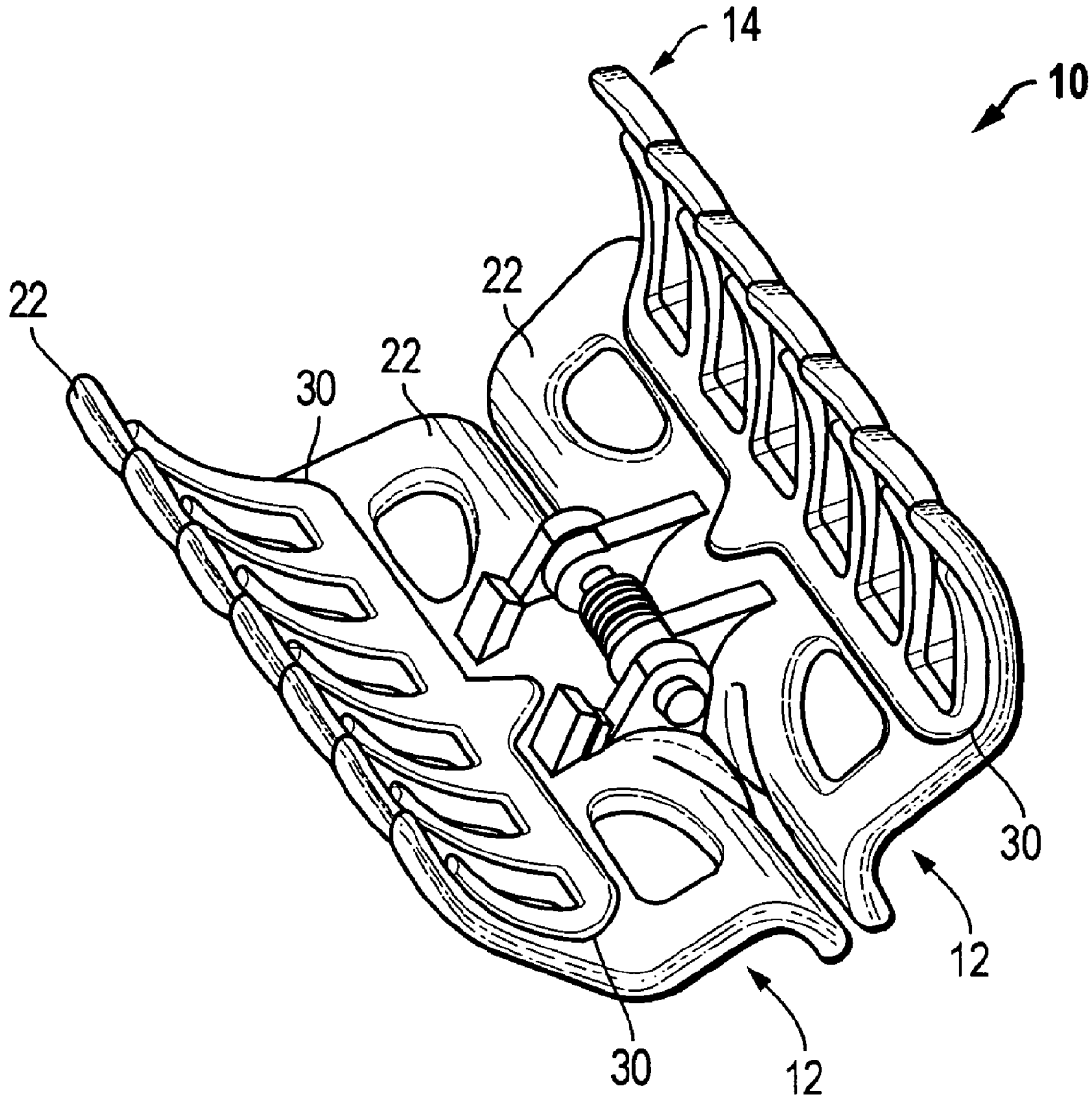

FIGS. 1-3 illustrate perspective views of an exemplary hair clip 10 according to the present invention. The exemplary hair clip 10 shown in the figures is configured as a jaw hair clip. However, the hair clip concepts and techniques disclosed herein are not limited to jaw hair clips and it will be recognized that these concepts and techniques may be applied to other types of hair clips including barrettes, hair bands, snap clips, hair snaps, hair claws, and the like (all of which may be considered herein as a hair clip).

As shown in FIGS. 1-3, the hair clip 10 may include two hair engagement members 12. The hair engagement members 12 in the exemplary embodiment shown may be the two opposed jaws of a jaw hair clip. The hair engagement members 12 may be comprised of comb-like teeth 14 and a main portion 16. The hair engagement member 12 may also include extension regions 18. A spring 20 may be placed in a manner to exert pressure against each hair engagement member 12 as shown. The spring 20 may be biased such that the hair engagement members 12 are normally biased closed as shown in FIGS. 1 and 2. Upon application of pressure against the extension regions 18 the hair engagement members 12 may be forced to an open position as shown in FIG. 10. The hair engagement member 12 may be comprised of a hard body 22. The hard body 22 may be formed of a hard plastic, metal or the like material. The comb-like teeth 14 and the main portion 16 may be both formed at least in part by the hard body 22. As will be described in more detail below, at least a portion of the hard body 22 may be initially formed to be hollow.

One or both of the hair engagement members 12 may also include gripping protrusions 30. As shown in FIGS. 1-3, the gripping protrusions 30 may protrude outward so as to form a gripping surface of the hair engagement members 12. As shown in the figures, the gripping protrusions 30 may be formed at booth the comb-like teeth 14 and the main portion 16 locations of the hair engagement members. However, it will be recognized that the gripping protrusions 30 need not be formed at both locations and it is merely desirable that the gripping protrusions 30 be formed in a manner such that they may engage a user's hair when the hair clip is in a closed position. As will be described in more detail below, an injection protrusions 32 may also be optionally formed as shown.

The gripping protrusions 30 may be formed of a material that has properties different from the material of the hard body 22. For example, the gripping protrusions 30 may be a softer and more compressible material that provides a cushion like effect. For some users the cushion like effect may provide a more comfortable and desirable feel during use. Alternatively, the gripping protrusions 30 may be formed of a material that has a higher coefficient of friction as compared to the hard body 22. In yet another embodiment, the gripping protrusions 30 may be both softer and have a higher coefficient of friction. In this manner, the gripping protrusions 30 may provide a surface that has more desirable comfort, gripping and/or holding functionality as compared to the surface of the hard body 22. Furthermore, the gripping protrusions 30 may be colored differently from the surface of the hard body 22 so as to provide a decorative feature.

The hard body 22 may be formed of any of a wide range of materials. For example, the hard body 22 may be formed of ABS (Acrylonitrile Butadiene Styrene) or general purpose polystyrene. Other materials may also be utilized for hard body 22 such as metal or other hard plastic materials. It is merely desirable that the hard body 22 provide sufficient structural support so as to make the hair clip 10 functional. In one embodiment, the hard body 22 may be formed of ABS having an ASTM Test Method D785 hardness of 103. In such an embodiment the hard body 22 may be formed utilizing injection molding techniques, however, other manufacturing techniques may be utilized. As is described in more detail below, at least portions of the hard body 22 may comprise void or hollow regions.

The gripping protrusions 30 and the injection protrusion 32 may be formed of a wide variety of types of synthetic or natural materials. For example, the protrusions may be formed of soft plastic, rubber or other soft materials. For example, in one embodiment the gripping protrusions 30 and the injection protrusion 32 may be formed of a thermoplastic elastomer. In one embodiment the thermoplastic elastomer having an ASTM Test Method D2240 hardness of Flash Shore 45A and 10 Second Hold Shore 40A. It will be recognized that materials of other hardness may be utilized and that generally the gripping material is merely formed of a material that is softer and/or of a different coefficient of friction as compared to the hard body 22.

At least portions of the hard body 22 may be comprised of hollow or void regions. The gripping protrusions 30 may then be formed by filling these hollow or void regions such that the gripping protrusions 30 extend or protrude outward from the hard body 22. In this manner the gripping protrusions 30 may be formed without having to glue or adhere the protrusions to a surface of the hard body 22. In one embodiment, the gripping protrusions 30 may be formed by injection molding the gripping material into the hard body 22. Other techniques to fill the hollow or void regions of the hard body 22 may also be used as it is merely desirable that the gripping material be formed partly within the hard body 22 and protrude outward beyond a surface of the hard body 22 so as to form a gripping protrusion.

Figure 4C:
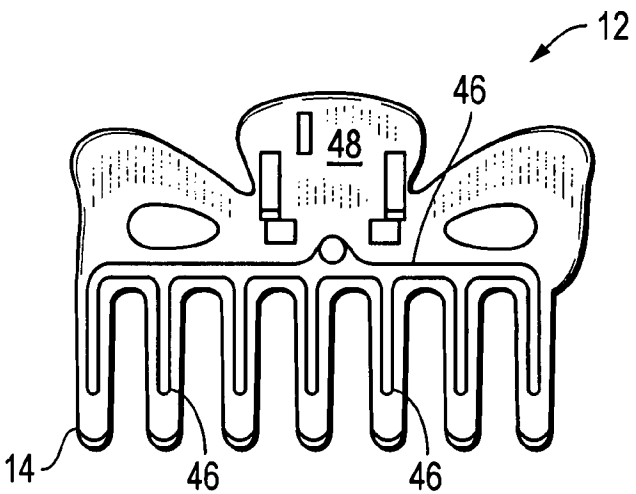
FIGS. 4A-4C illustrate plan views of an exemplary hair clip of the present invention prior to injection molding.
Figure 4B:
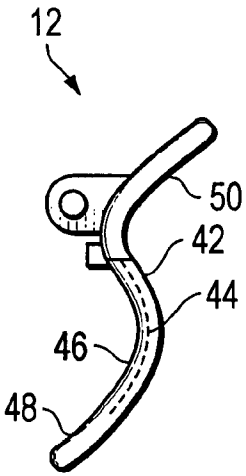
Figure 4A:
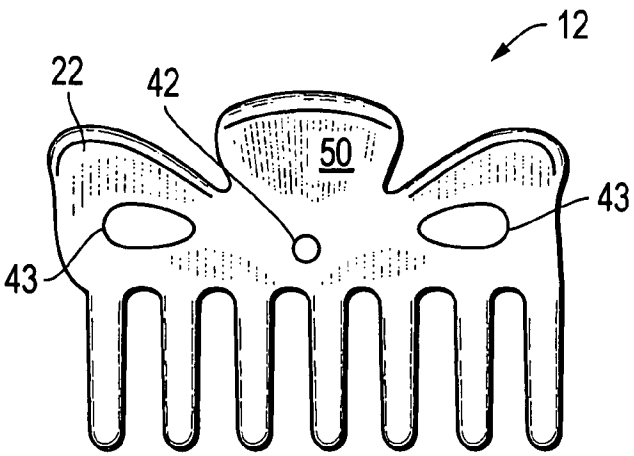
Figure 5C:
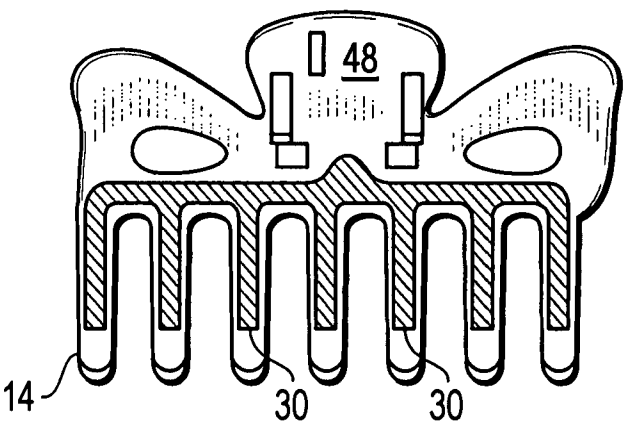
FIGS. 5A-5C illustrate plan views of an exemplary hair clip of the present invention after injection molding.
Figure 5B:
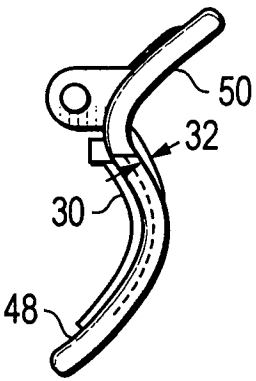
Figure 5A:
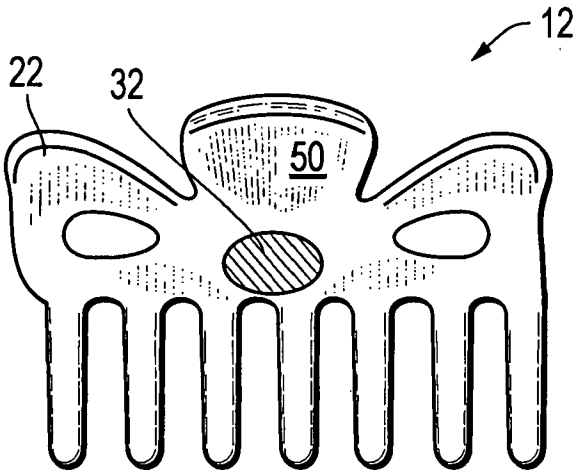

In one embodiment injection molding techniques may be utilized to form the gripping protrusions 30. FIGS. 4A-4C illustrate one hair engagement member 12 prior to injection molding the gripping material of the gripping protrusion 30 and FIGS. 5A-5C illustrate the hair engagement member 12 after injection molding of the gripping material. As shown in FIGS. 4A-4C the hair engagement member 12 may have an inner surface 48 of the hard body 22 and an outer surface 50 of the hard body 22. An injection hole 42 may be provided in the outer surface 50 so as to provide a location of injection for injecting the gripping material. Holes 43 may merely be decorative and are not utilize as part of the injection molding techniques.

As shown in FIGS. 4B and 4C, the injection hole 42 may be coupled to an internal channel 44 that is coupled with protrusion holes 46. The internal channel 44 forms a void space within the hard body 22. During the injection molding process, the gripping material may be injected into injection hole 42. The gripping material may then fill the internal channels 44 and then protrude or overflow out the protrusion hole 46. The internal channels may be hollow spaces or voids formed within the hard body 22. The internal channels 44 may be sized to exceed the size of the protrusion hole 46 so as to help retain the gripping material in its desired place when the gripping material fills the internal channel 44. As shown in FIG. 4C the protrusion hole 46 may be one continuous hole in the inner surface 50. However, alternatively, the protrusion hole 46 may be formed of a plurality of discrete holes in the inner surface 50 of the hard body 22.

FIGS. 5A-5C illustrate the hair engagement member 12 after the injection molding process. As shown in FIG. 5A, an injection protrusion 32 may be formed on the outer surface 50 at the location of the injection hole 42. The injection protrusion 32 may result from the injection molding process and provides both function and decorative effects. For example, the location of the injection protrusion 32 may provide a button like feature that aids in gripping the hair clip, particular when opening and closing the hair clip. In addition, the injection protrusion 32 may provide a decorative feature of the contrasting color of the gripping material on the outer surface 50 of the hard body 22. As shown in FIGS. 5B-5C the injection molding process also results in the gripping protrusions 30 extending outward from the inner surface of the hard body 22. The continuous formation of the protrusion hole 46 results in a gripping protrusion 30 that has the appearance of one continuous piece as the gripping protrusion is joined together at the end of each of the comb-like teeth 14. As mentioned above, the protrusion hole 46 may be formed of a plurality of discrete holes such that, for example, each of the teeth could have a separate protrusion hole that is not joined tied together at the end of the comb-like teeth 14. In this manner the gripping protrusions may appear to be separate protrusions located individually on each of the teeth.

As described herein, a hair clip is provided that has two types of surfaces wherein a first surface is softer than a second surface. Further, the material of the first surface may protrude outward of the second surface while filling at least a portion of a void that is formed within a body that forms the second surface. Although the exemplary hair clip utilized to help describe the techniques provided herein is a jaw hair clip, the concepts disclosed may be applicable to other hair clips. Moreover, although the exemplary technique for forming the softer first surface is an injection molding technique, other techniques for filling a portion of a hard body in a manner such that protrusions of the softer material may extend outward of the hard body may also be utilized.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. A method for forming a hair clip, comprising:

providing a hair engagement member comprised of a first material;

providing at least one void space within the hair engagement member;

filling at least a portion of the void space within the hair engagement member with a gripping material, wherein the gripping material has at least one property different from the first material; and protruding at least a portion of the gripping material through at least one hole in the first material so that the gripping material extends outward from a surface of the first material so as to provide a contact surface for gripping hair when the hair clip is in use, wherein the injection molding is utilized to accomplish the filling and protruding.

2. The method of claim 1 wherein the gripping material is injected into a first side of the hair engagement member and the gripping material protrudes outward of at least a second side of the hair engagement member.

3. The method of claim 1 wherein the hair clip is a jaw hair clip.

4. The method of claim 1 wherein the first material is harder than the gripping material.

5. The method of claim 1 wherein the first material has a coefficient of friction that is lower than the coefficient of friction of the gripping material.

6. The method of claim 1 wherein the gripping material is a thermoplastic eslatomer.

7. A method for forming a jaw hair clip, comprising:

providing at least one hair engagement member comprised of a hard material to form at least one jaw of the jaw hair clip;

providing at least one void space within the hair engagement member;

injection molding a gripping material within at least a portion of the void space within the hair engagement member; wherein the gripping material has at least one property different from the first material; and protruding at least a portion of the gripping material through at least one hole in a surface of the first hard material during the injection molding of the gripping material to form a gripping protrusion, wherein the gripping material is softer than the hard material.

8. The method of claim 6 wherein at least one gripping protrusion is formed in at least one tooth of the jaw hair clip.

9. The method of claim 8 wherein the first material comprises a hard plastic and the gripping material comprises a thermoplastic eslatomer.

10. The method of claim 8 wherein the gripping material is injected into an injection hole located in a portion of the hair engagement member other than a teeth portion.

11. The method of claim 6 wherein the gripping material protrudes outward from an injection molding injection hole.

12. A hair clip comprising:

a body formed of a first material;

a space formed within the body;

a hole that extends from an exterior surface of the main body to the space within the body;

a gripping material that is formed within at least a portion of the space within the main body and that extends through the hole outward of a surface of the first material, wherein the gripping material has at least one property different from the first material and wherein the extension of the gripping material through the hole forms a gripping protrusion that has a surface for gripping hair; and an injection protrusion that is formed at the location of an injection molding injection hole that is coupled to the space formed within the body.

13. The hair clip of claim 12 wherein the gripping protrusion and the injection protrusion are formed on different sides of the body.

14. The hair clip of claim 12 wherein the gripping protrusion is formed at least in part on one or more teeth of the jaw clip.

15. The hair clip of claim 12 wherein the gripping material is softer than the body.

16. The hair clip of claim 15 wherein the gripping protrusion is formed in a plurality of the teeth of the jaw clip.

17. The hair clip of claim 16 wherein the gripping material is a thermoplastic elsastomer.

18. The hair clip of claim 17 wherein the gripping protrusion extends through a plurality of discrete holes in the body.

* * * * *